United States Patent [19]

Lepisto

[11] 4,148,431

[45] Apr. 10, 1979

[54] COLLAPSIBLE HANDLE FOR MULTI-WALL BAG

[75] Inventor: J. George Lepisto, Middletown, Ohio

[73] Assignee: Champion International Corporation, Stamford, Conn.

[21] Appl. No.: 901,193

[22] Filed: Apr. 28, 1978

[51] Int. Cl.[2] ..... B65D 33/06

[52] U.S. Cl. ..... 229/54 R

[58] Field of Search ..... 229/54 R, 52 A; 150/12, 150/33

[56] References Cited

U.S. PATENT DOCUMENTS

| | | | |
|---|---|---|---|
| 2,050,967 | 8/1936 | Farmer | 229/54 R |
| 3,027,066 | 3/1962 | Vineberg | 229/54 R |
| 3,484,037 | 12/1969 | Kugler | 150/12 |

FOREIGN PATENT DOCUMENTS

| | | | |
|---|---|---|---|
| 542114 | 6/1957 | Canada | 150/12 |
| 695390 | 10/1964 | Canada | 229/54 R |
| 1151394 | 1/1958 | France | 229/54 R |

*Primary Examiner*—Stephen P. Garbe

*Attorney, Agent, or Firm*—Evelyn M. Sommer

[57] ABSTRACT

A collapsible handle is secured to the bottom edge of a flexible bag made of a multi-wall construction, with the handle being located in such manner as to not interfere during the normal bag filling operation. The handle includes two generally rectangular portions, each including a support portion that is adhesively bonded to one side of the bottom edge of the bag, and a second pivotally connected handle portion including a central aperture. The apertures of the handle portions are aligned to facilitate grasping of the handle by the user for carrying of the bag.

4 Claims, 5 Drawing Figures

COLLAPSIBLE HANDLE FOR MULTI-WALL BAG

The subject invention relates to a new and improved handle construction which is particularly suited for use in conjunction with a multi-wall bag made of stock type paper, such as Kraft paper, and plastic interlayers, and which may be employed for packaging of granular type materials, such as animal feed, etc.

It is an object of the subject invention to provide a collapsible handle which may be readily secured to a multi-bag in a location which will not interfere with the normal machine loading of the bag, and which is inexpensive to manufacture, yet sufficiently strong for the intended purpose.

It is another object of the subject invention to provide a redundant collapsible handle structure which is maintained in its collapsed position so as to insure that portions of the handle do not interfere with the automatic machine loading equipment during filling of the bag.

The above mentioned objects and advantages are achieved by a collapsible handle which is secured to a multi-wall bag along the bottom edge thereof, and which is maintained in its collapsed position by positive means in the form of adhesive bonding. More particularly, the collapsible handle of the subject invention is formed by two, generally rectangular sheets of paperboard material, each being foldable along a longitudinally extending fold line to sub-divide the paperboard sheet into a support portion and a handle portion. Each support portion is adhesively bonded to one of the opposite sides of the bottom edge of the bag, with the hinge line of the sheet being coextensive with the bottom crease of the multi-wall bag. The handle portion is die-cut to include a central aperture, with the central apertures of both handle portions being aligned to facilitate grasping of the handle when in its operative position. In the initial position, the handle portion is held coextensive with the support portion by an adhesive bead thereby insuring that the handle does not interfere with the automatic loading equipment when the bag is filled. The temporary adhesive bonding maintains the handle portion against the support portion until it is broken by the customer in order to pivot the respective handle portion to the operative position for carrying of the bag.

Further objects and advantages of the invention will become apparent from a reading of the following detailed description taken in conjunction with the drawings in which.

Figure 1:
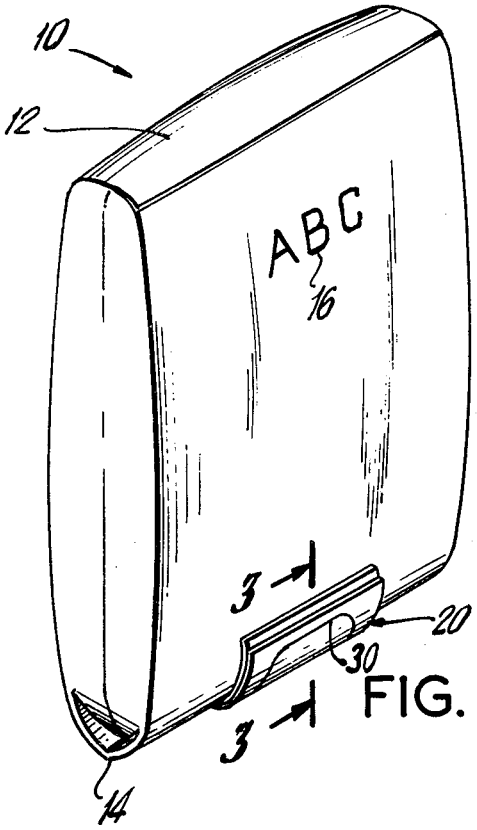
FIG. 1 is a perspective view of a multi-wall bag including a collapsible handle according to the subject invention.

Turning to FIG. 1, a flexible bag 10 is provided with a handle 20 made according to the subject invention, with the bag 10 being preferably made of a multi-wall construction including layers of paper material, such as Kraft paper, and intermediate layers of plastic sheets, as is commonly available in the industry. Bag 10 is particularly adapted for packaging of dry granular material, such as animal feed, oats, grain, etc., which granular material is designated by the numeral 18 in FIGS. 3 and 5. Bag 10 is generally rectangular in plan, including a top edge 12 and a bottom edge 14. Normally, bag 10 is machine loaded through the top edge 12 and following the filling operation, the top edge 12 is securely closed by suitable adhesive. The bottom edge 14 may include suitable tearable means for opening of the bag by the customer. Indicia 16 is placed on the various surfaces of the bag 10.

Since bag 10 is normally filled or loaded utilizing automatic filling apparatus, it is important that no obstruction is provided on the bag, especially along the top edge 12 through which the granular material 18 is loaded. In view of the bulkiness of the granular material 18, and its shiftability within the flexible bag 10, it is desirable that the bag 10 be provided with a handle means for carrying by the customer. To this end, the subject invention provides a handle 20 which is secured to the bottom edge 14, and which is collapsible so as to conform to the configuration of the bag 10 thereby insuring that the handle 20 does not interfere with the automatic filling or loading of the bag.

Figure 2:
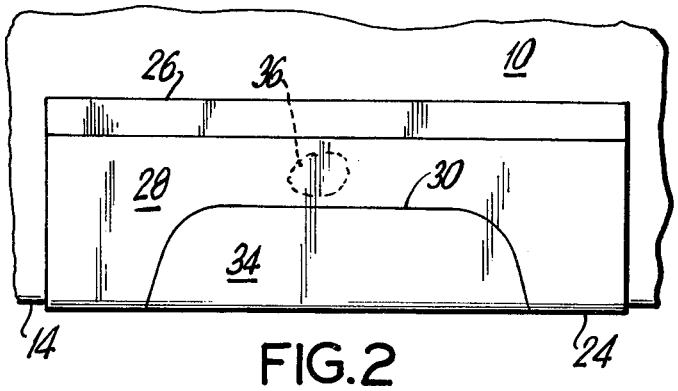
FIG. 2 is an elevational view of a collapsible handle of the subject invention.
Figure 3:
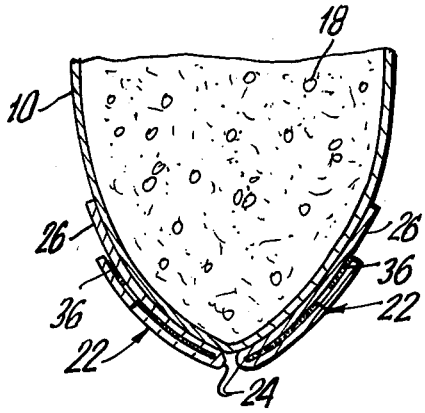
FIG. 3 is a cross-sectional view taken along line 3—3 in FIG. 1.

Referring to FIGS. 2 and 3, handle 20 is formed of two generally rectangular paperboard sheets 22 which are foldable about hinge line 24. Each foldable sheet includes a support portion 26 pivotally connected along hinge line 24 to handle portion 28. Each support portion 26, 26 is respectively bonded to the opposite sides of the bottom edge 14 of the bag 10, with the fold lines 24 being generally coextensive with said bottom edge. The integral pivotally connected handle portion 28 of each sheet 22 forms the handle portion of the handle 20.

Figure 4:
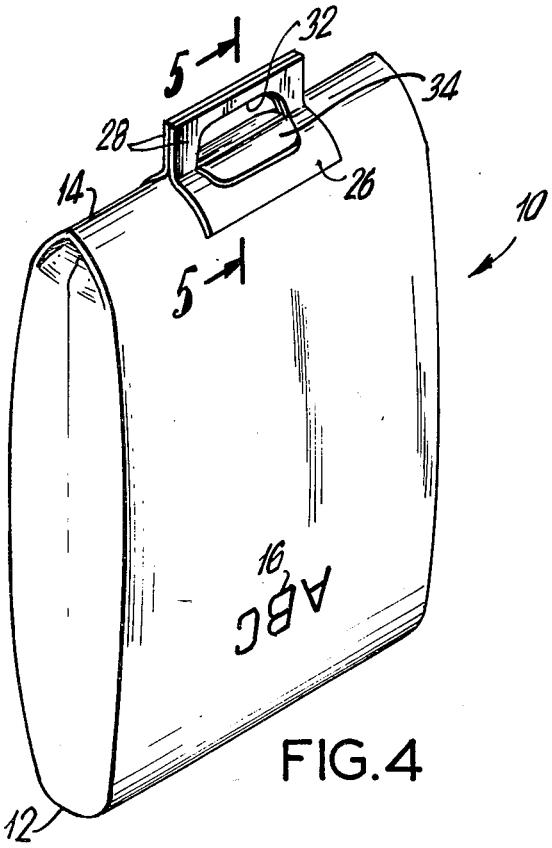
FIG. 4 is a perspective view of a multi-wall bag including a collapsible handle according to the subject invention in an operative position for carrying of the bag.
Figure 5:
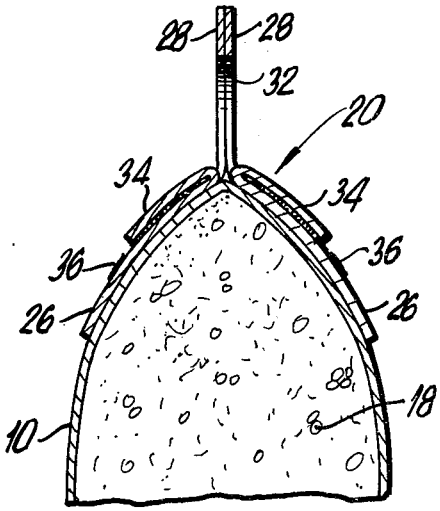
FIG. 5 is a cross-sectional view taken along line 5—5 in FIG. 4.

As illustrated in FIGS. 2, 4 and 5, each handle portion 28 is die-cut as at 30 thereby resulting in an aperture 32, with the apertures in each handle portion 28, 28 being aligned to be readily grasped by the user. As shown in FIGS. 2 and 4, each aperture 32 is generally elongated and extends generally parallel to the longitudinal axis of the bottom edge 14 of the bag. The remaining portion 34 of each handle portion is bonded to the support portion 26. In addition, as shown in FIG. 3, each handle portion 28 is bonded to its associated support portion 26 by a bead or spot of adhesive 36 so as to maintain the handle portion 28 in the collapsed position (as shown in FIGS. 1 and 3) during the filling of the bag. Subsequently, the temporary adhesive spots 36 are broken by the customer in order to raise the handle portions 28 to the positions illustrated in FIGS. 4 and 5 for carrying the bag 10 in the inverted position. The bag 10 may be provided with quick opening means in the form of a conventional pull string disposed adjacent the bottom closed edge 14 of the bag, which closure means are not shown in the drawings.

Accordingly, there is provided a new and improved collapsible handle in combination with a multi-wall paper bag utilized for packaging of granular material. The provision of the adhesive spots 36 for maintaining the handle portions 28 in the collapsed position, as shown in FIGS. 1 through 3, insures that the handle 20 does not interfere with the automatic filling equipment employed in the filling of the bag 10 through the top edge 12. However, after the bag has been filled, and the top edge 12 securely closed, it is merely necessary for the consumer to break the adhesive spots 36 in order to raise the handle portions 28 to the operative position illustrated in FIG. 4, thereby facilitating the carrying of the bulky bag 10.

Although the invention has been described and illustrated in connection with a single embodiment, it is readily apparent that various modifications and alterations may be made therein without departing from the spirit and scope of the invention as defined in the appended claims.

What is claimed is:

1. In combination with a paper bag having a fillable top portion and a rounded continuous closed bottom portion having a central peak portion for supporting the bag as it is being filled, a collapsible handle rigidly secured to the bottom portion of the bag, the collapsible handle including two opposed support portions, each support portion being secured to opposite sides of said peak portion and an integral handle portion hingedly connected to each support portion along a fold line, said fold lines being generally coextensive with said peak portion, the handle portions including aligned central apertures for facilitating grasping of the handle for carrying the bag in an inverted position, each of said handle portions initially being folded against and temporarily affixed to its associated support portion such that the handle substantially conforms to the configuration of the bottom portion of the bag, and the bag may be stood upright on the bottom portion thereof for filling through the top portion of the bag.

2. The combination of claim 1 wherein said support portions are adhesively bonded to the opposite sides of the bottom edge of the bag.

3. The combination of claim 1 wherein said collapsed handle is made of a paperboard material.

4. The combination of claim 1 wherein said aligned openings extend generally parallel to the bottom edge of the bag.

* * * * *